United States Patent [19]

Jenzsch et al.

[11] Patent Number: 4,637,558

[45] Date of Patent: Jan. 20, 1987

[54] VIBRATORY DECORING APPARATUS FOR CASTINGS

[75] Inventors: Günter Jenzsch, Adelsried; Kurt Rauh, Haimhausen; Hans J. Wegscheider, Gröbenzell, all of Fed. Rep. of Germany

[73] Assignee: Rudolph Mirbeth, Puchheim/BHF, Fed. Rep. of Germany

[21] Appl. No.: 752,046

[22] PCT Filed: Nov. 17, 1984

[86] PCT No.: PCT/DE84/00247

§ 371 Date: Jun. 27, 1985

§ 102(e) Date: Jun. 27, 1985

[87] PCT Pub. No.: WO85/02137

PCT Pub. Date: May 23, 1985

[30] Foreign Application Priority Data

Nov. 19, 1983 [DE] Fed. Rep. of Germany ..... 3341894

[51] Int. Cl.[4] ..... B02C 19/12

[52] U.S. Cl. ..... 241/79; 241/14; 241/284; 241/DIG. 10

[58] Field of Search ..... 241/24, DIG. 10, 79, 241/274, 275, 284, 14; 164/5, 412, 131, 250.1, 401

[56] References Cited

U.S. PATENT DOCUMENTS 4,296,794 10/1981 Leliaert ..... 164/401 X

FOREIGN PATENT DOCUMENTS 291439 4/1916 Fed. Rep. of Germany .

1151358 7/1963 Fed. Rep. of Germany .

OTHER PUBLICATIONS

Wheelabrator Resomatic, Wheelabrator-Frye Inc., bulletin No. 130,00.

*Primary Examiner*—Mark Rosenbaum

*Attorney, Agent, or Firm*—Marshall, O'Toole, Gerstein, Murray & Bicknell

[57] ABSTRACT

The decoring apparatus (1) consists of a portal-shaped support frame (2), at each of the vertical posts (4) and supports (5) on which a bracket (7) is provided. From each of these, via a swinging arm (9), a carrying unit (11) is suspended which is able to swing freely like a pendulum. Said carrying unit has two longitudinal arms (14,15) on which two vibrators (23) and two buffer bars (20) or an impact plate (19), as the case may be, are provided, whereby between the latter there is a casting receiving opening (16), and on the rear side of which several support bars (17) are provided. A casting (a) is loosely set into the receiving opening (16), and the carrying unit (11) is put into motion by vibrators (23). Since said vibrations induce the loose casting (a) to vibrate as well, the latter is quickly and freely moved back and forth between the impact plate (19) and the buffer bars (20) within a defined clearance (c), whereby the casting knocks against them in turn. By this, and due to vibrations induced into the casting (a), the sand cores contained therein disintegrate to sand and flows out at the bottom.

14 Claims, 3 Drawing Figures

VIBRATORY DECORING APPARATUS FOR CASTINGS

DESCRIPTION

The invention deals with a decoring apparatus for castings operating by means of vibration.

The known apparatus has a centrally arranged vibrator rigidly fastened to the frame, and from said vibrator, two vibratory pipes laterally project from each side, said pipes being each positioned in the center area of their longitudinal length, in a rigidly supported partition wall and lead from there to a casting clamping device. This device is rigidly retained at each of its upper and lower sides via a rubber bellows and provided, at each of the two facing front sides, with tension elements for a casting, whereby at the front sides, further rigidly supported rubber bellows on both sides of the vibratory pipes are provided, against which the casting tension device acts via an air gap. This device is expensively designed and expensive to manufacture. Furthermore, due to the clamping of the castings by the tension elements, which is difficult to automate, much time is wasted. Moreover, the rubber bellows provided at the upper and lower sides of the casting tension device are constantly subjected to impact or sudden compressive stress and tensile load by the vibration induced into them, which shortens their life span considerably. In addition, the horizontally arranged rubber bellows are constantly stressed by impact. The life span of the rubber bellows, in addition, is reduced by the natural aging of the rubber.

The object of this invention therefore is to design a device of the previously-mentioned type which does not have any parts yielding to extreme wear, which also is comparatively simply designed and where, above all, the respective casting can quickly and without problems be positioned without using any tension elements.

Due to the freely movable support arrangement of the carrying unit in the support frame together with the simultaneously loose positioning of the casting in the carrying unit and its displacement between the two facing stops within a defined clearance, the casting is induced to natural vibration by which the sand cores contained therein are disintegrated to sand and thus are destroyed by the vibrations induced into the carrying unit and directed in its displacement direction.

A slanted positioning of the carrying unit with a rear side support surface for the casting formed by individual support ribs, has the advantage that the loosened core sand can flow out of the casting by itself. The loose insertion and removal of the casting into or from the carrying unit respectively can not only be accomplished manually quickly, conveniently, and almost without any danger, but also can advantageously be done in an uncomplicated manner by a robot.

When the carrying unit is suspended in the support frame via swinging arms with commercially conventional rubber-metal supports or bearings, essentially no wear takes place at the supports. Furthermore, the friction in the supports (bearings) is small and, therefore, the efficiency is at an optimum.

The shape of the receiving opening provided in the carrying unit can be individually adjusted to any casting. By means of exchangeable buffer bars or an impact plate, respectively, in the receiving opening, castings of varying size can be placed in the same carrying unit.

A vibrator equipped with a frequency converter has the advantage that the necessary vibration frequency can be specifically adjusted to the number, size, and hardness of the sand core respectively in the casting, and therefore can be reliably disintegrated. For cores of usual size and hardness, however, vibrations of about 3000 vibrations/min. are induced into the carrying units by the vibrators. Mounting the vibrators directly on the carrying unit prevents wear, because transmission elements or the like are advantageously unnecessary.

In order to reduce the emitted operating noise of the apparatus, an easily detachable hood can be built around it, which has, on its inner wall, a noise-absorbing or silencing material.

The weight of the carrying unit is desirably to be a multiple greater than the weight of the casting, whereby best results are obtained when it has approximately seven to ten times greater weight than the latter.

A specific embodiment of the invention is illustrated in the attached in which.

Figure 1:
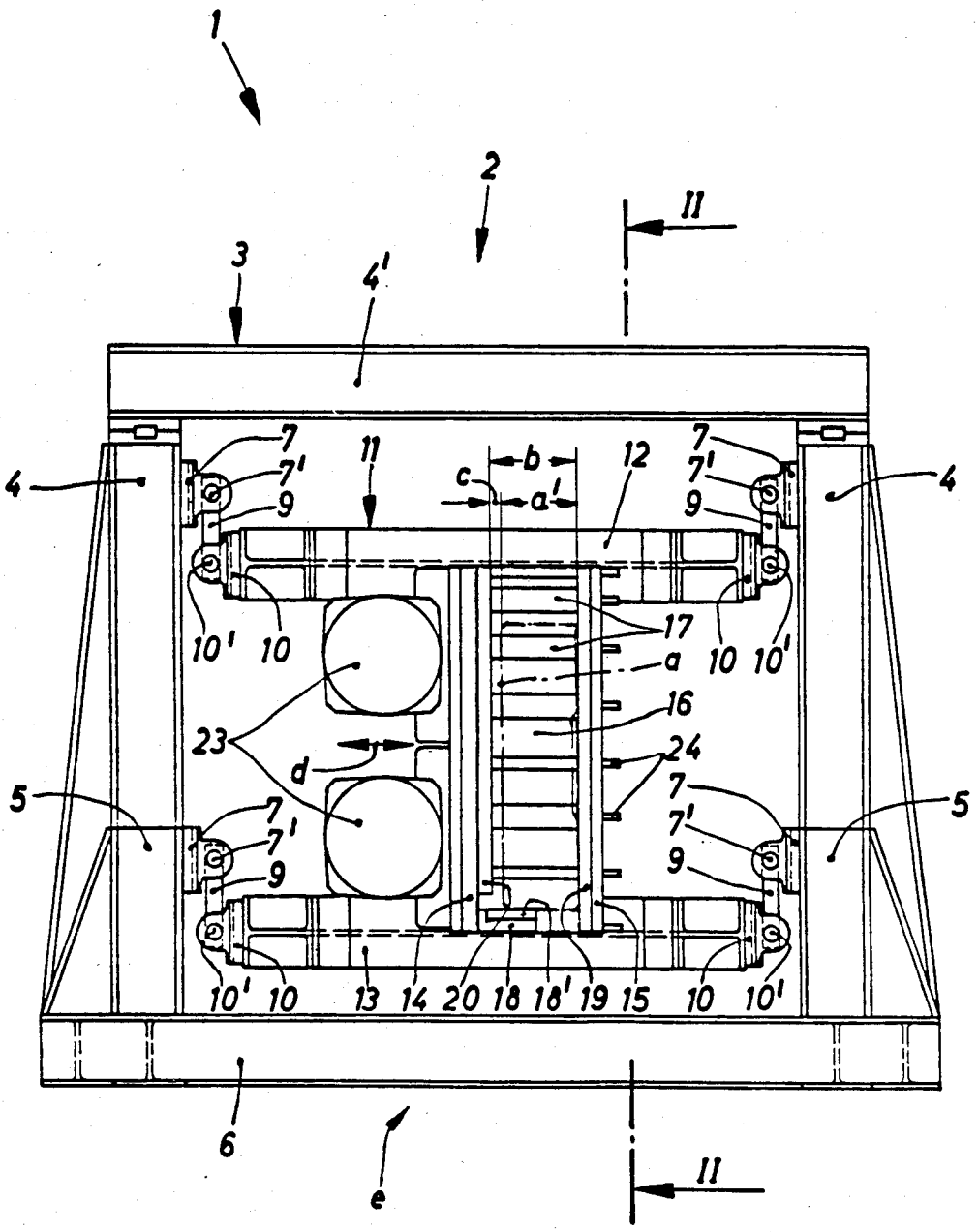
FIG. 1 is a front elevational view of the decoring apparatus.

As shown in FIG. 1, the apparatus 1 for decoring a casting is composed of a portal-shaped support frame 2 which consists of a U-shaped main frame 3 having two vertical supports 5 at a distance (FIG. 2) from two vertical posts 4 which are connected by a transverse beam 4'. Supports 5 are about ⅓ as high as the vertical posts 4 and together they are secured to a base frame 6. At the free end sections of each of the posts 4 and the supports 5, a support bracket 7 is located. At each of the four support brackets 7, via a bearing bolt 7', a short swinging arm 9 is swingably located which, with their other end, via a bearing bolt 10' at each, are articulated in the bolted-on bearing 10. These are fastened at the outside to a carrying unit 11 for carrying the casting, said carrying unit thus being suspended via swinging arms 9 in the support frame 2, like a pendulum, is freely swingable back and forth in one plane. The four swinging arms 9 are, from the support bearing side as well as from the screwed-on bearing side, each articulated via a rubber-metal support or bearing at the bearing bolts 7' or 10' respectively, and thus supported almost without wear.

Figure 3:
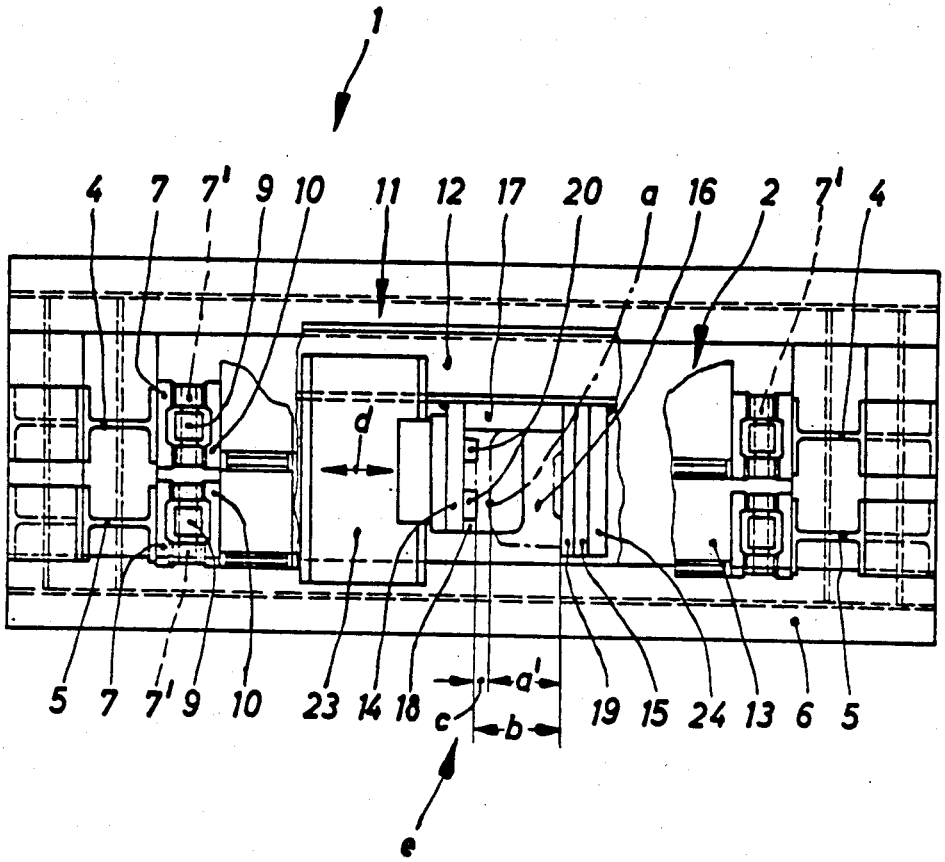
FIG. 3 is a plan view of the apparatus shown in FIG. 1.

The carrying unit 11 is made up of an upper carrying arm 12 and a lower carrying arm 13 which are connected via two vertical, spaced apart longitudinal arms 14,15. Due to this distance provided between them, a rectangular receiving opening 16 is provided which loosely receives a casting (FIGS. 1 and 3). The receiving opening 16 has a freely accessible feed side open from the front, while, at its rear side, a casting support is provided, which is formed by several horizontally running spaced apart support bars 17. These are fastened to the two longitudinal arms 14,15 respectively. At the lower end of the longitudinal arm 14, a support arm 18 is located which projects into the receiving opening 16, said support arm 18 having at its upper side a rubber layer or cladding 18'. On the support bars 17 and the support arm 18 lies the casting inserted into the receiving opening 16, whereby the rubber cladding 18' serves as a silencer during the decoring process. The rectangular receiving opening 16, furthermore, has at its broad side, which runs vertically and is formed by longitudinal arm 15, at the latter's inner side a screwed-on impact plate 19; while facing longitudinal arm 14 are two screwed-on spaced apart buffer bars 20 side-by-side and of equal thickness (FIG. 3). Instead of these, a buffer plate (not illustrated), can be screwed on the longitudinal arm 14. Between the contact sides of the impact plate 19 and the buffer bars 20 facing each other, there is an inner width (b), the length of which is composed of the respective maximum width (a') of the casting (a) and a defined clearance (c) (FIG. 3). This clearance (c) is determined empirically and is about four times as great as the respective amplitude produced by the vibrators 23 connected to the carrying unit 11. The term "amplitude" as used here means the distance the carrying unit 11 moves to the left or to the right while being shaken by the vibrators. If this movement, for instance, is 1.5 mm to the left and 1.5 mm to the right of zero position (3 mm total), a clearance (c) of 6 mm should be chosen since the amplitude is 1.5 mm.

To enable the opening 16 to carry castings of different width, the impact plate 19 or buffer bars 20, or the buffer plate respectively may have a varying thickness adjusted to the varying width of the castings and therefore are screwed on to the carrying unit 11, that means, they are exchangeably connected to the same. Alternatively, a separate intermediate part (not shown) adapted to the respective castings of varying width could be attached to each of the arms 14,15 by screws. Extra supporting ribs 24 can be attached to the outer side of such plates to provide reinforcement.

At the outer side of longitudinal arm 14 turned away from the receiving opening 16, two vibrators 23 are mounted one above the other, whereby the vibrations they produce are directed in the direction of displacement of the casting between the impact plate 19 and the buffer bars 20, in the direction of the double arrow (d).

Motor driven vibrators are desirably used although other types of vibrators, such as magnetic vibrators, or similar, can be used.

For achieving maximum, efficient frequency for the decoring process, at least one frequency converter (not illustrated) may be alloted to the vibrators 23. In the case under discussion, about 3000 vibrations per minute at a frequency of 50 Hz are induced into the carrying unit 11 by the two vibrators 23, by which said carrying unit and the casting are put into vibratory motion, which will be explained later on, whereby the cores contained in the casting disintegrate into loose sand. The weight of the carrying unit 11 purposefully amounts to seven to ten times the weight of the casting (a). Experience has shown that with these weight ratios, the best acceleration of the carrying unit 11 for the decoring process is $G=12$ to 15 by means of vibrators 23.

Figure 2:
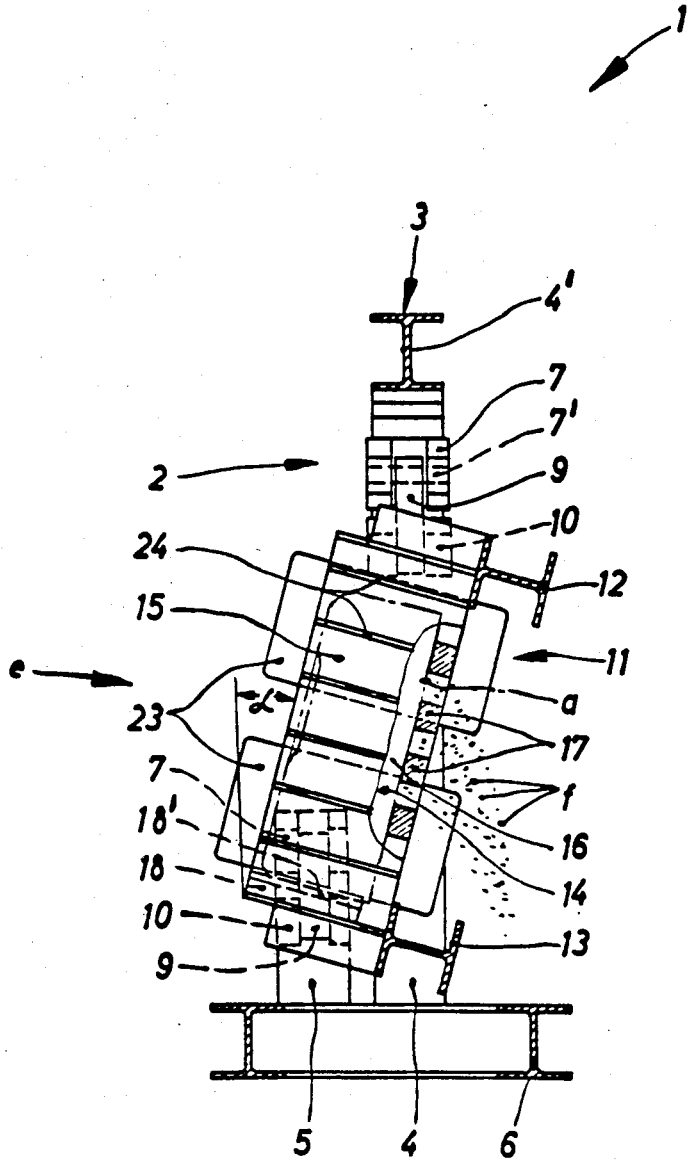
FIG. 2 is a sectional view taken along the line II—II of FIG. 1.

As shown in FIG. 2, the longitudinal arms 14,15 of the carrying unit 11, and thus of the supporting arm 18 running at a right angle to the longitudinal direction of the longitudinal arms 14,15, are arranged on the feed side (e) of the receiving opening 16 at an angle $\alpha$ of about 15° to the vertical line, so that the casting is positioned in the receiving opening 16 and rests on the rear support bars 17, by its own weight alone. For the purpose, the screwed-on bearings 10 provided at each of the free ends of the upper and lower carrying arms 12,13, are attached obliquely to the longitudinal direction of the carrying arms 12,13.

The entire decoring apparatus 1 is purposefully surrounded by a sound suppressing hood which is not illustrated, which, if needed, can be removed, and which carries on its inner walls an accoustic insulating material.

The decoring apparatus operates as follows:

When the carrying unit 11 is switched off, the casting (a) is placed into the receiving opening 16 at the feed side (e) either manually or by means of a robot, whereby it rests, freely, by its own weight alone, between the impact plate 19 and the buffer bars 20, on the support bars 17 and the supporting arm 18, whereby no further securing of the casting (a) is necessary. After switching on the vibrators 23, the carrying unit 11 is put into vibrating motion which is directed in the direction of displacement of the casting (a) (direction of the double arrow d), whereby the carrying unit 11 in the support frame 2 freely swings to and fro about 1.5 mm in each direction respectively. By this, the casting (a), within the defined clearance (c) which is to be adjusted to the respective casting (a), by merely resting on the support bars 17 and the support arm 18 by its own weight between the impact plate 19 and the buffer bars 20, is very quickly and freely moved back and forth, knocking the same; furthermore, the casting (a) is also put into vibratory motion by this. By means of the vibration and the respective hard, sudden knocking of the casting (a) at the impact plate 19 and the buffer bars 20 within the defined small clearance (c) (which amounts to 6 mm), e.g., the resin-bonded sand core disintegrates to sand. This sand can, as shown in FIG. 2 as numerous dots (f), ripple out downwardly, whereby the most favorable draining of the core sand takes place, when the core opening is turned towards the support bars 17. The vibrations induced in the casting by the vibrations of the carrying unit 11 can reach a higher frequency, because of self resonance of the casting, than the frequency of the carrying unit. By using a frequency converter connected to each vibrator 23, the optimal frequency for a particular casting can be selected.

The decoring time of a casting (a) of a passenger car engine (cylinder head or similar) by means of the described apparatus at 3000 vibrations/min. amounts to about 30 to 40 sec. Thereby the loose casting (a) is comparatively gently and evenly decored by freely hitting impact plate 19 and buffer bars 20. As compared to applying vibratory force at one point, any cracks hardly ever occur. Also, there is very little change of an accident in the area of the carrying unit 11, due to its slight lateral movement, namely about 1.5 mm to and fro, even at the start of vibratory action.

We claim:

1. Apparatus for removing core sand from a casting by vibration, comprising:

a framework;

a casting carrying unit including a pair of spaced apart horizontal arms;

means suspending the casting carrying unit from the framework so that the carrying unit can swing and vibrate freely along a path;

the means suspending the casting carrying unit from the framework comprising a pair of vertical spaced apart swingable arms, connected to both of the horizontal arms, which pivotally connect the end of each horizontal arm to the framework;

means to vibrate the casting carrying unit;

the casting carrying unit having a support bed on which a casting can rest loosely; and the support bed having spaced apart casting restraining means between which a casting fits with predetermined clearance so that the casting can slide between and hit the restraining means when the casting is vibrated.

2. Apparatus according to claim 1 in which the pair of horizontal arms and the pair of vertical arms define an opening in which a casting is received; and the support bed constituting means beneath the opening for supporting the casting in the opening.

3. Apparatus according to claim 2 in which the means to vibrate the casting carrying unit includes a vibrator mounted to one of the vertical arms.

4. Apparatus according to claim 3 in which each vibrator includes a frequency converter.

5. Apparatus according to claim 2 in which one side of the opening for the casting has an impact plate and an opposite side of the opening has a buffer bar or plate.

6. Apparatus according to claim 5 in which the buffer bar or plate is adjustable in relation to the impact plate.

7. Apparatus according to claim 5 in which the width between the impact plate and the buffer bar or plate is the sum of the width of the casting and a clearance distance, and the clearance distance is about four times the distance of the amplitude produced by the vibrator means.

8. Apparatus according to claim 7 in which the thickness of the impact plate and the thickness of the buffer bars or plate are selected to accommodate in the opening a casting of known width.

9. Apparatus according to claim 7 in which a distance or spacer plate is connected to one of the vertical arms to adjust the opening size to accept a casting.

10. Apparatus for removing core sand from a casting by vibration, comprising:

a framework including a horizontal base frame, two spaced apart vertical posts joined to the base frame, a beam connecting and joined to the tops of the posts, and two spaced apart vertical supports, about one-third the height of the posts, joined to the base frame;

a casting carrying unit;

means suspending the casting carrying unit from the framework so that the carrying unit can swing and vibrate freely along a path;

the means suspending the casting carrying unit from the framework including swingable arms which are pivotally connected to the top portions of the posts and vertical supports and to the casting carrying unit;

means to vibrate the casting carrying unit;

the casting carrying unit having a support bed on which a casting can rest loosely; and the support bed having spaced apart casting restraining means between which a casting fits with predetermined clearance so that the casting can slide between and hit the restraining means when the casting is vibrated.

11. Apparatus according to claim 10 in which the casting carrying unit is about 7 to 10 times heavier than the weight of the casting.

12. Apparatus according to claim 10 in which the swingable arm connections include rubber shock absorbing means.

13. Apparatus for removing core sand from a casting by vibration, comprising:

a framework;

a casting carrying unit;

the casting carrying unit including a pair of spaced apart horizontal arms;

a pair of vertical spaced apart arms connected to both of the horizontal arms;

swingable arms of fixed length pivotally connecting the end of each horizontal arm to, and suspending the casting carrying unit from, the framework so that the carrying unit can swing and vibrate freely along a path;

means to vibrate the casting carrying unit;

the casting carrying unit having a support bed on which a casting can rest loosely; and the support bed having spaced apart casting restraining means between which a casting fits with predetermined clearance so that the casting can slide between and hit the restraining means when the casting is vibrated.

14. Apparatus according to claim 13 in which the means to vibrate the casting carrying unit includes a vibrator mounted to one of the vertical arms.

* * * * *